US010704350B2

(12) United States Patent
Wan et al.

(10) Patent No.: US 10,704,350 B2
(45) Date of Patent: Jul. 7, 2020

(54) PROCESS FOR DRILLING NATURAL GAS HYDRATES WITH SUBMERSIBLE CORE DRILLING RIG USING PRESSURE WIRELINE

(71) Applicant: Hunan University of Science and Technology, Xiangtan, Hunan (CN)

(72) Inventors: Buyan Wan, Hunan (CN); Yongping Jin, Hunan (CN); Xiaojun Huang, Hunan (CN); Jialiang Wang, Hunan (CN)

(73) Assignee: Hunan University of Science and Technology, Xiangtan (CN)

( * ) Notice: Subject to any disclaimer, the term of this patent is extended or adjusted under 35 U.S.C. 154(b) by 0 days.

(21) Appl. No.: 16/731,068

(22) Filed: Dec. 31, 2019

(65) Prior Publication Data

US 2020/0131875 A1 Apr. 30, 2020

Related U.S. Application Data

(63) Continuation of application No. PCT/CN2019/080690, filed on Mar. 30, 2019.

(30) Foreign Application Priority Data

Aug. 13, 2018 (CN) ..... 2018 1 0914166

(51) Int. Cl.
*E21B 25/06* (2006.01)
*E21B 25/18* (2006.01)
(Continued)

(52) U.S. Cl.
CPC ..... *E21B 25/06* (2013.01); *E21B 25/18* (2013.01); *E21B 10/02* (2013.01); *E21B 19/14* (2013.01)

(58) Field of Classification Search
CPC ..... E21B 43/0115; E21B 25/06; E21B 10/02; E21B 19/14
See application file for complete search history.

(56) References Cited

U.S. PATENT DOCUMENTS 3,313,357 A * 4/1967 Venghiattis ..... E21B 7/1245 175/6
3,491,842 A * 1/1970 Castela ..... E21B 7/124 175/6
(Continued)

FOREIGN PATENT DOCUMENTS

CN 102606074 A 7/2012
CN 105239947 A 1/2016
(Continued)

*Primary Examiner* — James G Sayre
(74) *Attorney, Agent, or Firm* — Wayne & Ken, LLC; Tony Hom

(57) ABSTRACT

A process for drilling natural gas hydrates. A drilling rig is placed in seawater. A suction-press core drilling mode is adopted in a soft sediment formation, a suction-rotary core drilling mode is adopted in a medium-hard sediment formation, or a pumping direction circle-rotary core drilling mode is adopted in a hard sediment formation. A core is extracted. An inner tube for wireline pressure coring is recovered. A holding seal cap is tightened, and the inner tube is stored in a pipe storage rack. Punching is carried out. An inner tube for wireline pressure coring which is hollow is captured to disengage the holding seal cap. The inner tube is lowered. A drill rod is added. The punching is carried out again. The above steps are repeated until the core drilling reaches a given drilling depth. The drill rod, the drill and the corer are recovered.

8 Claims, 3 Drawing Sheets

(51) Int. Cl.
*E21B 10/02* (2006.01)
*E21B 19/14* (2006.01)

(56) References Cited

U.S. PATENT DOCUMENTS

| | | | | | |
|---|---|---|---|---|---|
| 3,741,320 | A * | 6/1973 | Hilfing | E21B 7/124 175/6 |
| 4,422,513 | A * | 12/1983 | Franklin | E21B 21/00 175/17 |
| 6,209,965 | B1 * | 4/2001 | Borns | E02F 3/925 299/17 |
| 6,394,192 | B1 * | 5/2002 | Frazer | E21B 7/124 175/58 |
| 2018/0355674 | A1 * | 12/2018 | Cooper | E21B 15/02 |

FOREIGN PATENT DOCUMENTS

| | | | | |
|---|---|---|---|---|
| CN | 107288565 | A | 10/2017 | |
| DE | 102005006039 | A1 | 8/2006 | |
| WO | WO-03021079 | A1 * | 3/2003 | E21B 43/34 |
| WO | 20180526274 | A1 | 3/2018 | |

* cited by examiner

PROCESS FOR DRILLING NATURAL GAS HYDRATES WITH SUBMERSIBLE CORE DRILLING RIG USING PRESSURE WIRELINE

CROSS-REFERENCE TO RELATED APPLICATIONS

This application is a continuation of International Application No. PCT/CN2019/080690, filed on Mar. 30, 2019, which claims the benefit of priority from Chinese Patent Application No. 201810914166.2, filed on Aug. 13, 2018. The content of the aforementioned applications, including any intervening amendments thereto, are incorporated herein by reference.

TECHNICAL FIELD

The application relates to a process for drilling natural gas hydrates with a submersible core drilling rig using pressure wireline.

BACKGROUND OF THE INVENTION

Subsea natural gas hydrates, as a new undersea energy resource have huge reserves. The global subsea gas hydrate reserves are twice as much as the existing natural gas and oil reserves. There are also abundant natural gas hydrates in the South China Sea and the East China Sea, which have broad development prospects. As a large developing country with a shortage of petroleum resources, China has determined a major strategic decision to explore and develop subsea natural gas hydrate resources as an alternative energy source. It is a necessarily technical step and a method to employ a submersible core drilling rig for a pressure coring on natural gas hydrates to determine the shapes of subsea gas hydrate bodies, to understand geological conditions of subsea gas hydrates and to conduct economic and technical evaluations of subsea gas hydrate resources. The subsea natural gas hydrates often appear staggered or mixed with sediments, sand or hard rocks on the sea floor, forming a soft formation represented by softer sediments, a medium-hard formation represented by a harder sediment formation, a sand formation or an incompletely consolidated hydrate formation, and a hard formation represented by a hard sediment formation, a fully consolidated hydrate formation or a hard rock formation. It lacks of technical experience of adopting submersible core drilling rigs using pressure wireline, submersible core drilling rigs using non-pressure wireline and ordinary submersible core drilling rigs using non-pressure to achieve high efficiency and high core recovery rate of subsea gas hydrates at home and abroad. Meanwhile, it is extremely critical to achieve pressure sealing of core samples because that the subsea natural gas hydrates are formed and stored under low temperature and high pressure. Therefore, the submersible core drilling rig using pressure wireline is used to achieve a high-efficiency coring for subsea gas hydrates and to realize pressure sealing at the same time.

SUMMARY OF THE INVENTION

To sole the above-mentioned problems, the invention provides a process for drilling natural gas hydrates with a submersible core drilling rig using pressure wireline, which has advantages such as high drilling efficiency, high core recovery rate, good pressure holding performance and high degree of automation.

The invention adopts the following technical solutions.

A process for drilling natural gas hydrates with a submersible core drilling rig using pressure wireline, comprising:

(1) placing a plurality of drill rods for wireline coring and a plurality of inner tubes for wireline pressure coring which are hollow and each equipped with a holding seal cap on a pipe storage rack of the submersible core drilling rig, placing one inner tube for wireline pressure coring which is hollow and free of the holding seal cap in an outer tube drill tool for wireline pressure coring, placing one holding seal cap in an unloading mechanism on the submersible core drilling rig, then lifting and placing the submersible core drilling rig into seawater, levelling and supporting the submersible core drilling rig via a levelling leg after the submersible core drilling rig lands on the seabed;

wherein the plurality of inner tubes for wireline pressure coring each comprise a bearing combination and a core snap ring with petals and is equipped with the holding seal cap and the outer tube drill tool for wireline pressure coring;

the submersible core drilling rig is provided with a high pressure seawater flushing pump, a seawater suction cylinder, a flushing water reversing valve and the unloading mechanism for the holding seal cap;

(2) when the formation to be drilled is a soft sediment formation, adopting a suction-press core drilling mode for drilling, comprising steps of: communicating an inlet of a rodless chamber of the seawater suction cylinder with an inner bore of the drill rod via the flushing water reversing valve, pressing a ring drill bit on a front of the outer tube drill tool for wireline pressure coring via the drill rod and the outer tube drill tool for wireline pressure coring by the drilling power head of the submersible core drilling rig, letting the ring drill bit cut into the subsea sediments at a constant speed, meanwhile using the seawater suction cylinder to suck seawater with an basically equivalent volume to a volume of the core samples in the inner tube for wireline pressure coring from the drill rod;

when the formation to be drilled is a harder sediment formation, a sand formation or an incompletely consolidated hydrate formation, adopting a suction-press core drilling mode for drilling; and when a propulsion of the drilling power head is more than 40% of the largest propulsion or the propulsion is 2 tons and the drilling speed is less than 9 mm/s and a drilling time is more than 1 min, adopting a suction-rotary core drilling mode for drilling, comprising steps of: starting a rotary driving of the drilling power head at the same time when the drilling power head propels down at a constant speed, driving the ring drill bit to rotatablycut into the subsea formation by the drill rod under a proper pressure, meanwhile sucking seawater by the seawater suction cylinder with an basically equivalent volume to a volume of the core samples in the inner tube for wireline pressure coring via the drill rod;

when the formation to be drilled is a hard sediment formation, a fully consolidated hydrate formation or a hard rock formation, adopting a suction-rotary core drilling mode; and when the propulsion of the drilling power head is more than 50% of the largest propulsion or the propulsion is larger than 2.5 tons and the drilling speed is less than 3 mm/s and a drilling time is more than 1 min, adopting a pumping direct circle-rotary core drilling mode for drilling, comprising steps of:

switching the flushing water reversing valve to communicate the water outlet of the high pressure seawater flushing pump with the inner bore of the drill rod, starting the high pressure seawater flushing pump, driving the ring drill bit to rotatablycut into the subsea formation by the drill rod, meanwhile letting the high pressure seawater flow through the drill rod and a ring interval between the inner tube for wireline pressure coring and the outer tube drill tool for wireline pressure coring to the water outlet of the ring drill bit till a drilling bottom, cooling the ring drill bit and carrying rock powder at the drilling bottom back to a drilling port along the drill rod and the ring interval;

wherein the water outlet of the high pressure seawater flushing pump and the inlet of the rodless chamber of the seawater suction cylinder are communicated with the inner bore of an active drill rod of the drilling power head via the flushing water reversing valve and a water pipe, the flushing water reversing valve switches to communicate the inner bore of the active drill rod of the submersible core drilling rig with the water outlet of the high pressure seawater flushing pump or the inlet of the rodless chamber of the seawater suction cylinder; the rod chamber of the seawater suction cylinder is communicated with outer seawater; a top of a piston rod of the seawater suction cylinder and a top of a piston rod of a propulsion cylinder of the submersible core drilling rig are hinged to synchronize the seawater suction cylinder and the propulsion cylinder of the submersible core drilling rig;

(3) operating the drilling power head to move upward after the roundtrip drilling ends, cutting the core using the core snap ring with petals installed on the inner tube for wireline pressure coring, then operating the drilling power head carrying with the drill rod, the outer tube drill tool for wireline pressure coring and the inner tube for wireline pressure coring to move upward to an unloading position of the wireline pressure coring inner tube;

(4) lowering the extractor by the recovery winch, recovering the inner tube for wireline pressure coring loading with the core to the submersible core drilling rig, disengaging and separating the active drill rod with the drill rod, then lifting up the active drill rod to a high position, and moving the inner tube for wireline pressure coring loading with the core to a position above the unloading mechanism;

(5) tightening the holding seal cap to the inner tube for wireline pressure coring via the unloading mechanism to seal the wireline pressure coring inner tube, and placing the inner tube for wireline pressure coring loading with the core on the pipe storage rack of the submersible core drilling rig;

(6) reconnecting the active drill rod to the drill rod, switching the flushing water reversing valve to communicate the water outlet of the high pressure seawater flushing pump with the inner bore of the drill rod, starting the high pressure seawater flushing pump and the rotary drilling of the drilling power head, and punching several times using the high pressure seawater flushing pump, wherein the punching process is that the drilling power head drives the drill rod and the outer tube drill tool for wireline pressure coring to move 1.5~2.0 m upward and stays for 20~30 s, then moves downward to the drilling bottom;

(7) disengaging and separating the active drill rod with the drill rod, then lifting up to the active drill rod a highest position, delivering one inner tube for wireline pressure coring which is hollow from the pipe storage rack of the submersible core drilling rig to an upper position of the unloading mechanism, disengaging the holding seal cap from the inner tube for wireline pressure coring which is hollow;

(8) lowering the inner tube for wireline pressure coring which is hollow and free of the holding seal cap in the outer tube drill tool for wireline pressure coring;

(9) adding one drill rod;

(10) punching several times according to the method of step (6);

(11) punching according to either or both of step (6) and step (10); determining whether the drilling depth reaches a given drilling depth, if yes, then proceeding to next step; if not, then repeating steps (2)~(10) till the given drilling depth is reached;

(12) recovering the drill rod and the outer tube drill tool for wireline pressure coring; and

(13) recovering the submersible core drilling rig.

In step (2), the submersible core drilling rig has a pressing speed of 18~22 mm/s.

In step (2), when the suction-rotary core drilling mode is adopted, the drilling power head has a rotary speed of 30~150 r/min and a drilling speed of 2~6 mm/s.

In step (2), when the pumping direct circle-rotary core drilling mode is adopted, the drilling power head has a rotary speed of 30~150 r/min and a drilling speed of 1~5 mm/s, and the high pressure seawater flushing pump has a pump rate of 50~100 L/min.

In step (2), when the pumping direct circle-rotary core drilling mode is adopted, and when the drilling speed increases to 8 mm/s and retains for 20 s, the suction-rotary core drilling mode is adopted.

In step (2), when the suction-rotary core drilling mode is adopted, and when the drilling speed increases to 18 mm/s and retains for 20 s, the suction-press core drilling mod is adopted.

In step (4), the extractor is lowered by the recovery winch at a lowering speed of 18~25 m/min.

In steps (6) and (10), when a drilling depth is less than 10 m, the punching process is repeated 2~3 times; when the drilling depth is in a range of 10 m~30 m, the punching process is repeated 3~4 times; when the drilling depth is more than 30 m, the punching process is repeated more than 5 times; when the punching is downward, the high pressure seawater flushing pump has a pump rate of 50~80 L/min; when the punching is upward, the high pressure seawater flushing pump has a pump rate of 100~200 L/min.

Compared with the prior arts, the invention has the following beneficial effects:

1) The invention switches the suction-press core drilling mode, the suction-rotary core drilling mode and the pumping direct circle-rotary core drilling mode automatically by an automatic control system or manually according to different formations, efficiently improving the drilling efficiency and the core recovery rate.

2) The invention employs the unloading mechanism to tighten the holding seal cap to the inner tube for wireline pressure coring, achieving sealing of the inner tube for wireline pressure coring and providing a good pressure holding performance.

3) The invention realizes a full-automatic remote controlled drilling process with the submersible core drilling rig, achieving high degree of automation and high drilling efficiency, and efficiently reducing the operation cost.

Figure 1:
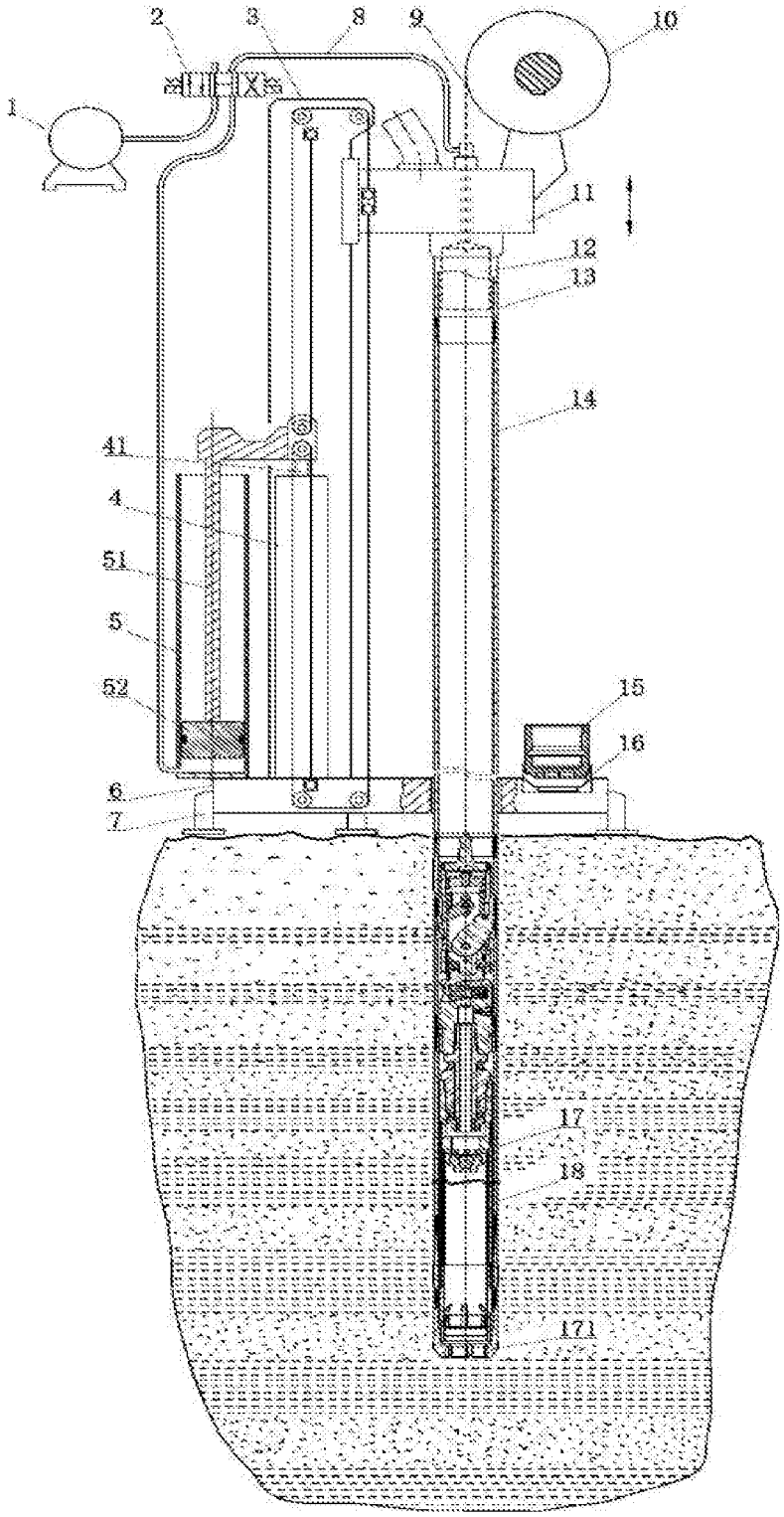
FIG. 1 is a schematic diagram of process for drilling natural gas hydrates with a submersible core drilling rig using pressure wireline according to the invention.

In the drawings, 1—high pressure seawater flushing pump, 2—flushing water reversing valve, 3—slide rack of drilling power head, 4—propulsion cylinder, 41—piston rod of propulsion cylinder, 5—seawater suction cylinder, 51—piston rod of seawater suction cylinder, 52—piston of seawater suction cylinder, 6—base, 7—levelling leg, 8—water pipe, 9—recovery wireline, 10—recovery winch, 11—drilling power head, 12—extractor, 13—active drill rod of drilling power head, 14—drill rod, 15—holding seal cap, 16—unloading mechanism of holding seal cap, 17—outer tube drill tool for wireline pressure coring, 171—ring drill bit, 18—inner tube for wireline pressure coring, 181—bearing combination, 182—core snap ring with petals.

DETAILED DESCRIPTION OF EMBODIMENTS

The invention will be further described with reference to the companying drawings.

The process for drilling natural gas hydrates with a submersible core drilling rig using pressure wireline includes the following steps.

(1) A plurality of drill rods 14 for wireline coring and a plurality of inner tubes 18 for wireline pressure coring which are hollow and each equipped with a holding seal cap 15 are placed on a pipe storage rack of the submersible core drilling rig. One inner tube 18 for wireline pressure coring which is hollow and free of the holding seal cap is placed in an outer tube drill tool 17 for wireline pressure coring. One holding seal cap 15 is placed in an unloading mechanism 16 on the submersible core drilling rig. The submersible core drilling rig is lifted and placed into seawater. The submersible core drilling rig is levelled and supported via a levelling leg 7 after the submersible core drilling rig lands on the seabed.

Figure 2:
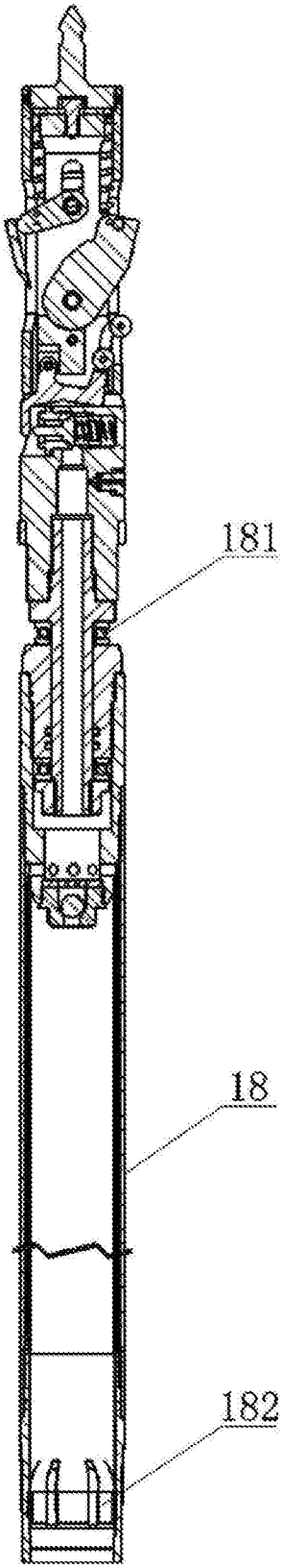
FIG. 2 schematically shows an inner tube for wireline pressure coring according to the invention.
Figure 3:
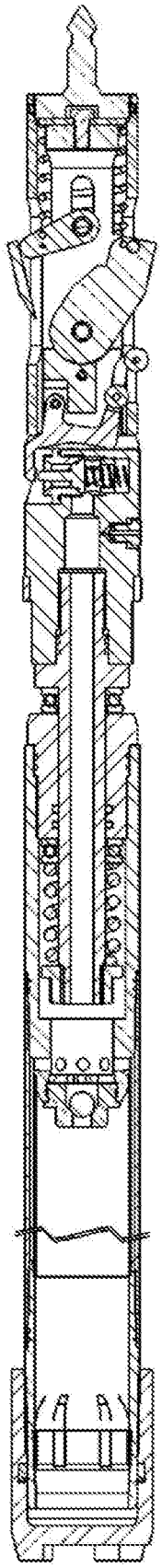
FIG. 3 schematically shows the inner tube for wireline pressure coring when a holding seal cap is tightened to the inner tube for wireline pressure coring according to the invention.

As shown in FIGS. 1~3, the plurality of inner tubes 18 for wireline pressure coring each comprise a bearing combination 181 and a core snap ring 182 with petals and is equipped with the holding seal cap 15 and the outer tube drill tool 17 for wireline pressure coring;

the submersible core drilling rig is provided with a high pressure seawater flushing pump 1, a seawater suction cylinder 5, a flushing water reversing valve 2 and the unloading mechanism 16 for the holding seal cap 15;

(2) When the formation to be drilled is a soft sediment formation, a suction-press core drilling mode for drilling is adopted, including steps of: communicating an inlet of a rodless chamber of the seawater suction cylinder 5 with an inner bore of the drill rod 14 via the flushing water reversing valve 2, pressing a ring drill bit 171 on a front of the outer tube drill tool 17 for wireline pressure coring via the drill rod 14 and the outer tube drill tool 17 for wireline pressure coring by the drilling power head 11 of the submersible core drilling rig, letting the ring drill bit 171 cut into the subsea sediments at a constant speed, meanwhile using the seawater suction cylinder 5 to suck seawater with an basically equivalent volume to a volume of the core samples in the inner tube 18 for wireline pressure coring from the drill rod 14.

The submersible core drilling rig has a pressing speed of 18~22 mm/s.

When the formation to be drilled is a harder sediment formation, a sand formation or an incompletely consolidated hydrate formation, a suction-press core drilling mode for drilling is adopted; and when a propulsion of the drilling power head 11 is more than 40% of the largest propulsion or the propulsion is 2 tons and the drilling speed is less than 9 mm/s and a drilling time is more than 1 min, a suction-rotary core drilling mode for drilling is adopted, comprising steps of: starting a rotary driving of the drilling power head 11 at the same time when the drilling power head 11 propels down at a constant speed, driving the ring drill bit 171 to rotatablycut into the subsea formation by the drill rod 14 under a proper pressure, meanwhile sucking seawater by the seawater suction cylinder 5 with an basically equivalent volume to a volume of the core samples in the inner tube 18 for wireline pressure coring via the drill rod 14. When the suction-rotary core drilling mode is adopted, the drilling power head 11 has a rotary speed of 30~150 r/min and a drilling speed of 2~6 mm/s, and when the drilling speed increases to 18 mm/s and retains for 20 s, the suction-press core drilling mode is adopted.

When the formation to be drilled is a hard sediment formation, a fully consolidated hydrate formation or a hard rock formation, a suction-rotary core drilling mode is adopted; and when the propulsion of the drilling power head 11 is more than 50% of the largest propulsion or the propulsion is larger than 2.5 tons and the drilling speed is less than 3 mm/s and a drilling time is more than 1 min, a pumping direct circle-rotary core drilling mode for drilling is adopted, comprising steps of:

switching the flushing water reversing valve 2 to communicate the water outlet of the high pressure seawater flushing pump 1 with the inner bore of the drill rod 14, starting the high pressure seawater flushing pump 1, driving the ring drill bit 171 to rotatablycut into the subsea formation by the drill rod 14, meanwhile letting the high pressure seawater flow through the drill rod 14 and a ring interval between the inner tube 18 for wireline pressure coring and the outer tube drill tool 17 for wireline pressure coring to the water outlet of the ring drill bit 171 till a drilling bottom, cooling the ring drill bit 171 and carrying rock powder at the drilling bottom back to a drilling port along the drill rod 14 and the ring interval. When the pumping direct circle-rotary core drilling mode is adopted, the drilling power head 11 has a rotary speed of 30~150 r/min and a drilling speed of 1~5 mm/s, and the high pressure seawater flushing pump 1 has a pump rate of 50~100 L/min, and when the drilling speed increases to 8 mm/s and retains for 20 s, the suction-rotary core drilling mode is adopted.

As shown in FIGS. 1-3, the water outlet of the high pressure seawater flushing pump 1 and the inlet of the rodless chamber of the seawater suction cylinder 5 are communicated with the inner bore of an active drill rod 13 of the drilling power head 11 via the flushing water reversing valve 2 and a water pipe 8, the flushing water reversing valve 2 switches to communicate the inner bore of the active drill rod 13 of the submersible core drilling rig with the water outlet of the high pressure seawater flushing pump 1 or the inlet of the rodless chamber of the seawater suction cylinder 5; the rod chamber of the seawater suction cylinder 5 is communicated with outer seawater; a top of a piston rod 51 of the seawater suction cylinder 5 and a top of a piston rod 41 of a propulsion cylinder 4 of the submersible core drilling rig are hinged to synchronize the seawater suction cylinder 5 and the propulsion cylinder 4 of the submersible core drilling rig.

The propulsion cylinder 4 and the seawater suction cylinder 5 are installed on a base 6. A slide rack 3 of the drilling power head 11 is installed on the base 6, where one side of the slide rack 3 of the drilling power head 11 is arranged with a vertical slide, and the drilling power head 11 is settled on the vertical slide to move vertically along the vertical slide. Moreover, a plurality of levelling legs 7 is arranged in a bottom of the base 6. Two pulleys are arranged up and down on an upper end of the piston rod 41 of the propulsion cylinder 4. A top and a bottom of the slide rack 3 of the drilling power head 11 are arranged with pulleys respectively. One end of an upper wireline is connected to the top of the slide rack 3 of the drilling power head 11, another end of the upper wireline successively bypasses an upper pulley of the two pulleys arranged on the upper end of the piston rod 41 of the propulsion cylinder 4 and pulleys on the top of the slide rack 3 of the drilling power head 11 to connected to the drilling power head 11. One end of a lower wireline is connected to the bottom of the slide rack 3 of the drilling power head 11, another end of the lower wireline successively bypasses a lower pulley of the two pulleys arranged on the upper end of the piston rod 41 of the propulsion cylinder 4 and pulleys on the bottom of the slide rack 3 of the drilling power head 11 to connected to the drilling power head 11. The active drill rod 13 is arranged on the drilling power head 11. The active drill rod 13 can connect to not only an upper thread of the drill rod 14, but also an upper thread of the outer tube drill tool 17 for wireline pressure coring, and a lower thread of the drill rod 14 can connect to the upper thread of the outer tube drill tool 17 for wireline pressure coring. A hole for communicating with the active drill rod 13 is further arranged on the drilling power head 11. An extractor 12 is arranged in the active drill rod 13. One end of a recovery wireline 9 is connected to the extractor 12 and another end of the recovery wireline 9 passes through the hole on the drilling power head 11 and connects to a recovery winch 10.

(3) The drilling power head 11 is operated to move upward after the roundtrip drilling ends, the core is cut by the core snap ring 182 with petals installed on the inner tube 18 for wireline pressure coring, then the drilling power head 11 carrying with the drill rod 14, the outer tube drill tool 17 for wireline pressure coring and the inner tube 18 for wireline pressure coring is operated to move upward to an unloading position of the inner tube 18 for wireline pressure coring.

(4) The extractor 12 is lowered by the recovery winch 10 at a lowering speed of 18~25 m/min, the inner tube 18 for wireline pressure coring loading with the core is recovered to the submersible core drilling rig at a speed of 30~40 m/min, the active drill rod 13 is disengaged and separated with the drill rod 14, then the active drill rod 13 is lifted up to a high position, and the inner tube 18 for wireline pressure coring loading with the core is moved to a position above the unloading mechanism 16.

(5) The holding seal cap 15 is tightened to the inner tube 18 for wireline pressure coring via the unloading mechanism 16 to seal the inner tube 18 for wireline pressure coring, and the inner tube 18 for wireline pressure coring loading with the core is placed on the pipe storage rack of the submersible core drilling rig.

(6) The active drill rod 13 is reconnected to the drill rod 14, the flushing water reversing valve 2 is switched to communicate the water outlet of the high pressure seawater flushing pump 1 with the inner bore of the drill rod 14, the high pressure seawater flushing pump 1 and the rotary drilling of the drilling power head 11 are started, and the high pressure seawater flushing pump 1 punches several times, where the punching process is that the drilling power head 11 drives the drill rod 14 and the outer tube drill tool 17 for wireline pressure coring to move 1.5~2.0 m upward and stays for 20~30 s, then moves downward to the drilling bottom. When a drilling depth is less than 10 m, the punching process is repeated 2~3 times; when the drilling depth is in a range of 10 m~30 m, the punching process is repeated 3~4 times; when the drilling depth is more than 30 m, the punching process is repeated more than 5 times; when the punching is downward, the high pressure seawater flushing pump 1 has a pump rate of 50~80 L/min; when the punching is upward, the high pressure seawater flushing pump 1 has a pump rate of 100~200 L/min.

(7) The active drill rod 13 is disengaged and separated with the drill rod 14, then the active drill rod 13 is lifted up to a highest position, one inner tube 18 for wireline pressure coring which is hollow is delivered from the pipe storage rack of the submersible core drilling rig to an upper position of the unloading mechanism 16, the holding seal cap 15 is disengaged from the inner tube 18 for wireline pressure coring which is hollow.

(8) With the corporation of the mechanical arm, the extractor 12 and the recovery winch 10, the inner tube 18 for wireline pressure coring which is hollow and free of the holding seal cap 15 is lowered in the outer tube drill tool 17 for wireline pressure coring.

(9) One drill rod 14 is added.

(10) The punching process is repeated several times according to the method of step (6).

(11) The punching process is proceeding according to either or both of step (6) and step (10). It is determined whether the drilling depth reaches a given drilling depth, if yes, then next step is proceeded to; if not, steps (2)~(10) are repeated till the given drilling depth is reached.

(12) The drill rod 14 and the outer tube drill tool 17 for wireline pressure coring are recovered.

(13) The submersible core drilling rig is recovered.

What is claimed is:

1. A process for drilling natural gas hydrates with a submersible core drilling rig using pressure wireline, comprising:

(1) placing a plurality of drill rods for wireline coring and a plurality of inner tubes for wireline pressure coring which are hollow and each equipped with a holding seal cap on a pipe storage rack of the submersible core drilling rig, placing one inner tube for wireline pressure coring which is hollow and free of the holding seal cap in an outer tube drill tool for wireline pressure coring, placing one holding seal cap in an unloading mechanism on the submersible core drilling rig, then lifting and placing the submersible core drilling rig into seawater, levelling and supporting the submersible core drilling rig via a levelling leg after the submersible core drilling rig lands on the seabed;

wherein the plurality of inner tubes for wireline pressure coring each comprise a bearing combination and a core snap ring with petals and is equipped with the holding seal cap and the outer tube drill tool for wireline pressure coring;

the submersible core drilling rig is provided with a high pressure seawater flushing pump, a seawater suction cylinder, a flushing water reversing valve and the unloading mechanism for the holding seal cap;

(2) when the formation to be drilled is a soft sediment formation, adopting a suction-press core drilling mode for drilling, comprising steps of: communicating an inlet of a rodless chamber of the seawater suction cylinder with an inner bore of the drill rod via the flushing water reversing valve, pressing a ring drill bit on a front of the outer tube drill tool for wireline pressure coring via the drill rod and the outer tube drill tool for wireline pressure coring by the drilling power head of the submersible core drilling rig, letting the ring drill bit cut into the subsea sediments at a constant speed, meanwhile using the seawater suction cylinder to suck seawater with an basically equivalent volume to a volume of the core samples in the inner tube for wireline pressure coring from the drill rod;

when the formation to be drilled is a harder sediment formation, a sand formation or an incompletely consolidated hydrate formation, adopting a suction-press core drilling mode for drilling; and when a propulsion of the drilling power head is more than 40% of the largest propulsion or the propulsion is 2 tons and the drilling speed is less than 9 mm/s and a drilling time is more than 1 min, adopting a suction-rotary core drilling mode for drilling, comprising steps of: starting a rotary driving of the drilling power head at the same time when the drilling power head propels down at a constant speed, driving the ring drill bit to rotatablycut into the subsea formation by the drill rod under a proper pressure, meanwhile sucking seawater by the seawater suction cylinder with an basically equivalent volume to a volume of the core samples in the inner tube for wireline pressure coring via the drill rod;

when the formation to be drilled is a hard sediment formation, a fully consolidated hydrate formation or a hard rock formation, adopting a suction-rotary core drilling mode; and when the propulsion of the drilling power head is more than 50% of the largest propulsion or the propulsion is larger than 2.5 tons and the drilling speed is less than 3 mm/s and a drilling time is more than 1 min, adopting a pumping direct circle-rotary core drilling mode for drilling, comprising steps of:

switching the flushing water reversing valve to communicate the water outlet of the high pressure seawater flushing pump with the inner bore of the drill rod, starting the high pressure seawater flushing pump, driving the ring drill bit to rotatablycut into the subsea formation by the drill rod, meanwhile letting the high pressure seawater flow through the drill rod and a ring interval between the inner tube for wireline pressure coring and the outer tube drill tool for wireline pressure coring to the water outlet of the ring drill bit till a drilling bottom, cooling the ring drill bit and carrying rock powder at the drilling bottom back to a drilling port along the drill rod and the ring interval;

wherein the water outlet of the high pressure seawater flushing pump and the inlet of the rodless chamber of the seawater suction cylinder are communicated with the inner bore of an active drill rod of the drilling power head via the flushing water reversing valve and a water pipe, the flushing water reversing valve switches to communicate the inner bore of the active drill rod of the submersible core drilling rig with the water outlet of the high pressure seawater flushing pump or the inlet of the rodless chamber of the seawater suction cylinder; the rod chamber of the seawater suction cylinder is communicated with outer seawater; a top of a piston rod of the seawater suction cylinder and a top of a piston rod of a propulsion cylinder of the submersible core drilling rig are hinged to synchronize the seawater suction cylinder and the propulsion cylinder of the submersible core drilling rig;

(3) operating the drilling power head to move upward after the roundtrip drilling ends, cutting the core using the core snap ring with petals installed on the inner tube for wireline pressure coring, then operating the drilling power head carrying with the drill rod, the outer tube drill tool for wireline pressure coring and the inner tube for wireline pressure coring to move upward to an unloading position of the wireline pressure coring inner tube;

(4) lowering the extractor by the recovery winch, recovering the inner tube for wireline pressure coring loading with the core to the submersible core drilling rig, disengaging and separating the active drill rod with the drill rod, then lifting up the active drill rod to a high position, and moving the inner tube for wireline pressure coring loading with the core to a position above the unloading mechanism;

(5) tightening the holding seal cap to the inner tube for wireline pressure coring via the unloading mechanism to seal the wireline pressure coring inner tube, and placing the inner tube for wireline pressure coring loading with the core on the pipe storage rack of the submersible core drilling rig;

(6) reconnecting the active drill rod to the drill rod, switching the flushing water reversing valve to communicate the water outlet of the high pressure seawater flushing pump with the inner bore of the drill rod, starting the high pressure seawater flushing pump and the rotary drilling of the drilling power head, and punching several times using the high pressure seawater flushing pump, wherein the punching process is that the drilling power head drives the drill rod and the outer tube drill tool for wireline pressure coring to move 1.5~2.0 m upward and stays for 20~30 s, then moves downward to the drilling bottom;

(7) disengaging and separating the active drill rod with the drill rod, then lifting up to the active drill rod a highest position, delivering one inner tube for wireline pressure coring which is hollow from the pipe storage rack of the submersible core drilling rig to an upper position of the unloading mechanism, disengaging the holding seal cap from the inner tube for wireline pressure coring which is hollow;

(8) lowering the inner tube for wireline pressure coring which is hollow and free of the holding seal cap in the outer tube drill tool for wireline pressure coring;

(9) adding one drill rod;

(10) punching several times according to the method of step (6);

(11) punching according to either or both of step (6) and step (10); determining whether the drilling depth reaches a given drilling depth, if yes, then proceeding to next step; if not, then repeating steps (2)~(10) till the given drilling depth is reached;

(12) recovering the drill rod and the outer tube drill tool for wireline pressure coring; and

(13) recovering the submersible core drilling rig.

2. The drilling process of claim 1, wherein in step (2), the submersible core drilling rig has a pressing speed of 18~22 mm/s.

3. The drilling process of claim 1, wherein in step (2), when the suction-rotary core drilling mode is adopted, the drilling power head has a rotary speed of 30~150 r/min and a drilling speed of 2~6 mm/s.

4. The drilling process of claim 1, wherein in step (2), when the pumping direct circle-rotary core drilling mode is adopted, the drilling power head has a rotary speed of 30~150 r/min and a drilling speed of 1~5 mm/s, and the high pressure seawater flushing pump has a pump rate of 50~100 L/min.

5. The drilling process of claim 1, wherein in step (2), when the pumping direct circle-rotary core drilling mode is adopted, and when the drilling speed increases to 8 mm/s and retains for 20 s, the suction-rotary core drilling mode is adopted.

6. The drilling process of claim 1, wherein in step (2), when the suction-rotary core drilling mode is adopted, and when the drilling speed increases to 18 mm/s and retains for 20 s, the suction-press core drilling mode is adopted.

7. The drilling process of claim 1, wherein in step (4), the extractor is lowered by the recovery winch at a lowering speed of 18~25 m/min and is recovered with the inner tube for wireline pressure coring loading the core at a speed of 30~40 m/min.

8. The drilling process of claim 1, wherein in steps (6) and (10), when a drilling depth is less than 10 m, the punching process is repeated 2~3 times; when the drilling depth is in a range of 10~30 m, the punching process is repeated 3~4 times; when the drilling depth is more than 30 m, the punching process is repeated more than 5 times; when the punching is downward, the high pressure seawater flushing pump has a pump rate of 50~80 L/min; when the punching is upward, the high pressure seawater flushing pump has a pump rate of 100~200 L/min.

* * * * *